United States Patent [19]

Gladwin

[11] 3,978,910

[45] Sept. 7, 1976

[54] MOLD PLATE COOLING SYSTEM

[76] Inventor: Floyd R. Gladwin, 21000 E. River Road, Grosse Ile, Mich. 48138

[22] Filed: July 7, 1975

[21] Appl. No.: 593,619

[52] U.S. Cl. ..... 164/283 M; 249/79

[51] Int. Cl.[2] ..... B22D 27/04

[58] Field of Search ..... 249/79, 80, 81; 164/283 S, 283 MS, 297, 283 M, 82, 273 R, 282, 283, 126, 128, 348

[56] References Cited

UNITED STATES PATENTS

| | | | |
|---|---|---|---|
| 3,049,769 | 8/1962 | Schultz | 249/79 X |
| 3,289,257 | 12/1966 | Richards | 164/273 R |
| 3,662,814 | 5/1972 | Kipp | 164/273 R X |
| 3,730,257 | 5/1973 | Haussner | 164/273 R X |
| 3,750,743 | 8/1973 | Barber | 164/273 R X |
| 3,763,920 | 10/1973 | Auman | 164/82 |

*Primary Examiner*—Francis S. Husar
*Assistant Examiner*—John S. Brown
*Attorney, Agent, or Firm*—Cullen, Settle, Sloman & Cantor

[57] ABSTRACT

A continuous slab casting mold plate formed of an inner face plate fastened face to face to an outer backing plate, and having curved side edges. A number of narrow, parallel grooves are formed in the surface of the face plate, with the grooves covered by the adjacent backing plate surface. The grooves are curved to correspond to the arc of curvature of the plate side edges. A shallow pocket is formed in the backing plate surface at each of the groove ends so that each pocket overlaps all of its adjacent groove ends. A water-carrying passageway through the backing plate communicates each pocket to the exposed backing plate surface for thereby, circulating cooling water through the grooves for continuously cooling the face plate.

3 Claims, 5 Drawing Figures

23
15
24
25
26
29
28
33
30
31

23
16
34
21
18
17

24
25
26
15
29
28
30
5
4
31
23
22
21
16

14
18
11
12
13
15
17
16
10

26
29
18
15
32
3
21
20
17
14
16

MOLD PLATE COOLING SYSTEM

BACKGROUND OF THE INVENTION

In the continuous casting of steel slab, a long, roughly rectangular shaped in cross section, tubular shaped mold is used. Molten steel is poured into the upper, open end of the tube and flows through the tubular mold to gradually cool and solidify and, thereafter emerge from the opposite end thereof.

Such continuous molds are very large and heavy and, thus, are normally formed of mold sections, each forming a segment of the tubular mold, with the sections fastened together end to end to form the continuous mold passageway. Such sections are normally made of four plate-like members, namely, a pair of large primary or main mold members which are spaced apart in parallelism and a pair of side plate members.

In the casting process, the steel is normally poured downwardly to gravity flow through the tubular mold. However, the mold is normally curved along the direction of flow of the metal so that, ultimately, the cooled metal emerges in a horizontal direction for conveying away from the mold. Thus, it is necessary to curve the inner faces of the mold section primary or main plates so that each section continues the curvature of the preceding section and adds to it, to finally produce a right-angle turn in the flow of the metal. For this purpose, as well as to provide a casting surface or surface for contacting the metal and cooling it, the mold plates are usually formed in two parts. That is, the plates are formed of an outer backing plate member which may be a solid plate or a fabricated plate with suitable reinforcements, and an inner face plate which usually is formed of a copper or copper-like material which is a good heat conductor.

Suitable slot type cavities or passageways are formed in such plates for purposes of circulating water therethrough and thereby, providing a cooling medium for extracting the heat from the metal being cast. The efficiency of such cooling is important since it is relevant to the amount of water needed, the pumping and power and plumbing systems for supplying and removing water and also the rate of solidification of the metal being cast. Hence, the invention herein relates to an improved cooling system for the mold section side edge plate members which improves the efficiency and overall cooling of the system and eliminates temperature differences caused by curved type plates and straight type slots.

SUMMARY OF INVENTION

The invention herein relates to an improved cooling system for continuous casting, mold section, side edge mold plates and, particularly, those formed with curved edges. The invention contemplates forming numerous arcuately curved grooves in the surface of the face plate which grooves are covered by an overlapping surface of the mold member backing plate which contains passageways for flowing water into and out of the grooves for cooling the face plates. The grooves are curved to approximate the curvature of the edges of the side mold member to form parallel, closely adjacent curved water-carrying channels. The opposite ends of the grooves are curved in depth, that is, gradually increasing in depth along a curve to form smooth flowing inlet and outlet portions at the opposite ends of the grooves. These end portions are overlapped by transverse pockets or depressions formed in the overlapping face of the backing plate, which pockets are connected, through passageways, to the exposed face of the backing plate for connection to water pipes for supplying and removing water in a continuous manner.

The backing plate is usually made of steel and may be of a single plate or of a fabricated plate construction with rib reinforcements, as may be needed. The facing plate would normally be made of a copper or a copper-like material having a high heat conductivity so that its inner surface may contact the metal being cast and rapidly convey heat therefrom.

While the sizes of the continuous casting mold sections and the mold plates forming such sections may vary considerably, depending upon the size slabs being cast, by way of example only, a typical mold section may have an interior, roughly rectangular-shaped cavity, which may be on the order of three to eight feet or so in width, roughly two to three feet in height and on the order of about 4 inches to 14 inches in depth. Thus, as can be seen, the overall continuous casting mold, made up of a large number of such sections, is of very considerable size. With this type of construction, even small increases in efficiency of cooling becomes quite significant in the economy of the operation. Thus, the formation of the curved cooling grooves increases the cooling efficiency of the side edge mold members which cumulatively along the entire casting mold has a significant effect upon the economy of and efficiency of cooling and the efficiency of the casting operation. Further, O-ring maintenance is reduced, since such rings tend to be injured by the temperature differentials.

These and other objects and advantages of this invention will become apparent upon reading the following description, of which the attached drawings form a part.

DETAILED DESCRIPTION

Figure 1:
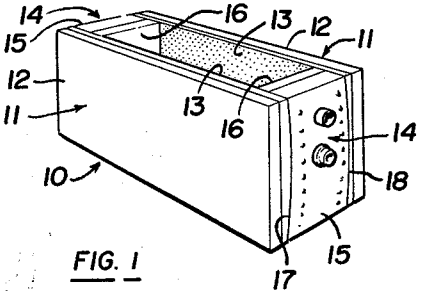
FIG. 1 illustrates, in perspective, a continuous slab casting mold section.
Figure 2:
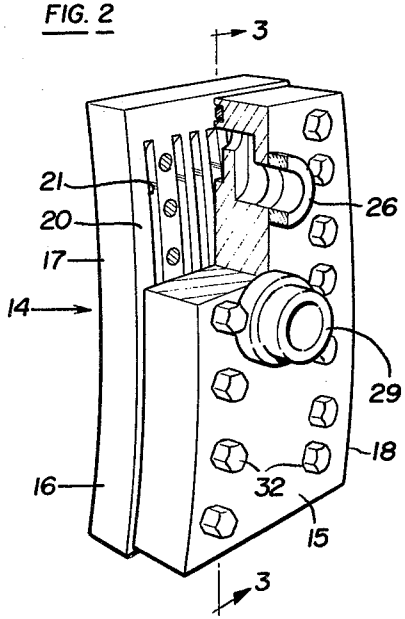
FIG. 2 is an enlarged, perspective, partially cross-sectioned view of the mold section side edge member.

FIG. 1 illustrates a continuous casting mold section 10 which is roughly rectangular in shape to form a roughly rectangular-shaped casting cavity. This section is adapted to be arranged in alignment with other sections to form an elongated, large tubular-shaped continuous casting precision mold.

The mold section is formed of a pair of primary or main mold plate members 11, each formed of an outer backing plate 12 and an inner face plate 13. The outer backing plate may be of a steel construction formed of either a monolithic plate or a fabricated construction with reinforcing ribs on the outside surface. The inner face plate 13 is preferably formed of copper or a copper-like material which is a good heat conductor. The inner surfaces of the face plate are curved to a very large radius, i.e., 10 feet or more, so that they are parallel.

The mold also includes side mold plate members 14, each having an outer backing plate 15 of steel or the like and an inner face plate 16 of copper or copper-like material. The side mold plate members fit between and are suitably bolted or clamped between the main or primary mold plate members. Thus, the side mold plate members are formed with curved side edges 17 and 18 respectively, each being an arc of a large radius circle.

The surface 20 of the face plate which is contacted by the corresponding surface of the backing plate 15, is provided with a number of narrow, curved grooves or channels or slots 21 whose widths are considerably less than their depths, e.g., ¼ inch width as against ¾ inch depth in a typical installation.

The grooves or channels 21 are curved to an arc of a circle corresponding to the arcs of curvature of the side edges 17 and 18 to, thus, form what appears to be a succession of progressively smaller arcs arranged in parallelism. Preferably, the channels 21 are spaced apart an equal distance, one from the next.

The opposite ends of the grooves are formed as curved-end portions 22 which gradually increase in depth along a smooth curve and, thereby, form inlet and outlet portions for each groove. Each of these inlet and outlet portions is overlapped by a depression or pocket 23, formed in the overlapping surface of the backing plate. Such pockets are relatively shallow but are transversely wide so as to overlap all of the adjacent ends of the grooves. Each pocket is connected by an inlet hole 24 to a water-supply system. Thus, as shown in the drawings, an upper passageway 25, which is relatively short, connects to the upper pocket and extends through the backing plate to communicate with a tubular outlet fitting 26, which may be welded to the backing plate. Correspondingly, a passageway 28 communicates the lower pocket to a tubular inlet fitting 29, welded to side plate member. The passageways also help in cooling the plate.

The inlet and outlet tubular fittings are connected through plumbing pipes to a pumping system for pumping water therethrough for a continuous cooling flow. Such plumbing fittings and pumping systems are conventional and, hence, are omitted here.

In order to secure the backing plate to the face plate in a manner to contain the water in the grooves, a peripherally-extending sealing groove 30 is formed in the surface of the backing plate adjacent and parallel to the margin thereof. A sealing strip 31 is fitted into the groove, which strip is preferably made of a relatively resilient material which is capable of withstanding the normal heat encountered. One suitable commercially available material is formed of a silicone which appears to be a rubbery-like strip and which compresses upon forcing the backing plate against the face plate.

Figure 5:
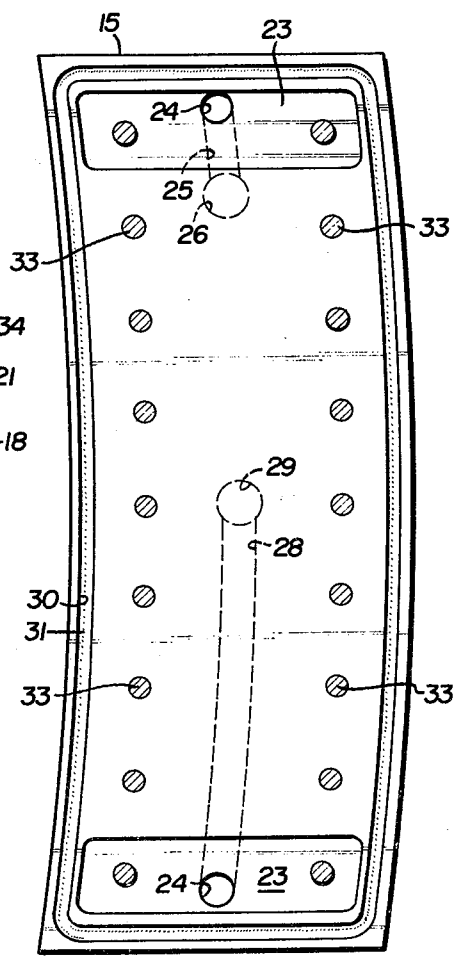
FIG. 5 is a view of the corresponding face of the backing plate and is taken in the direction of arrows 5—5 of FIG. 3.
Figure 4:
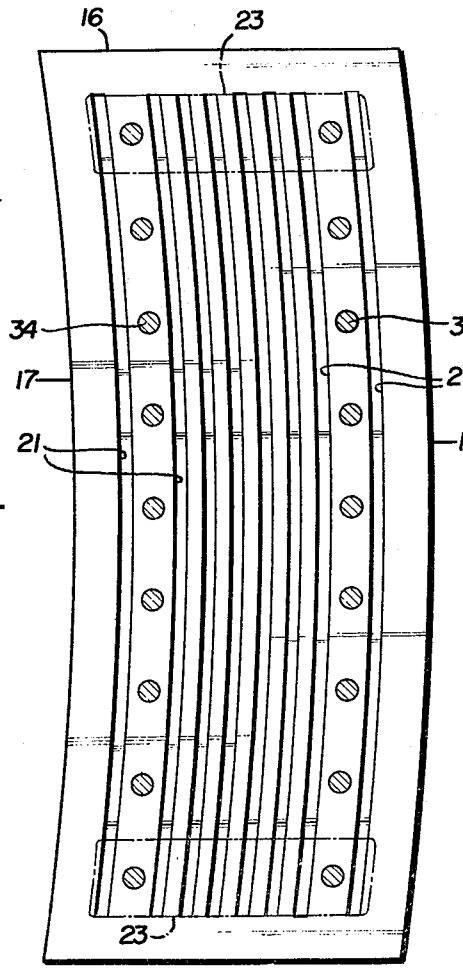
FIG. 4 is a view of the grooved face of the face plate and is taken in the direction of arrows 4—4 of FIG. 3.
Figure 3:
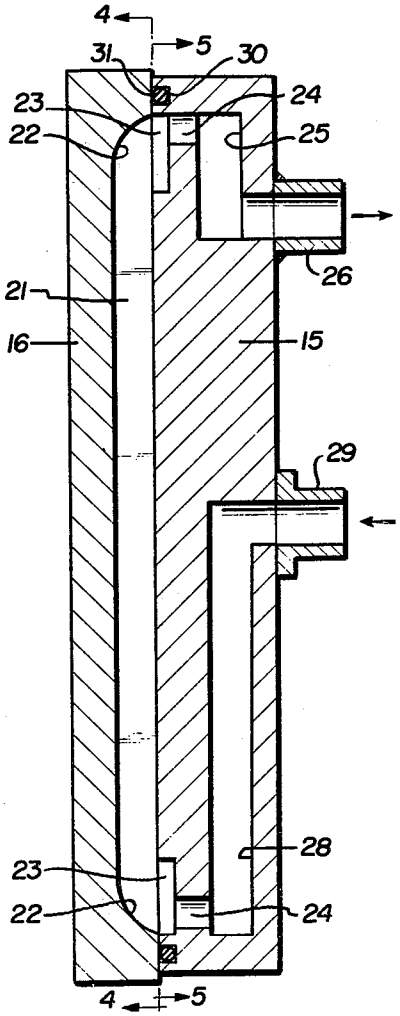
FIG. 3 is a cross-sectional view of the side edge member taken in the direction of arrows 3—3 of FIG. 2.

Machine screws 32 extend through holes 33 in the backing plate and threadedly engage corresponding-threaded holes 34 in the face plate to secure the plates together into a double thickness side plate member for the mold. For illustration purposes, FIG. 4 shows the adjacent slots 21, between which the holes 34 are located, being spaced apart a greater distance than other adjacent slots. Preferably, to the extent possible, all of the slots are spaced apart approximately an equal distance.

The configuration of the group of grooves formed in the face plate provides a smooth, low turbulant, flow of cooling water which draws heat from the face plate and, in turn, from the metal being cast in an efficient manner. The curved configuration of the grooves, particularly, permits maximum equal cooling of the plate.

Having fully described an operative embodiment of this invention, I now claim:

1. In a cooling system for a continuous slab-casting mold section, double-thickness mold plate formed of a substantially flat backing plate and face plate arranged and secured together in a face-to-face relationship so that the exposed surface of the face plate forms a molding surface and the opposite surface of the face plate is in full face-to-face contact with the adjacent surface of the backing plate, a group of approximately equal length closely spaced narrow grooves formed in the surface of the face plate and opening toward the backing plate with said grooves being roughly parallel to each other and extending from near the one end to near the opposite end of the face plate;

a continuous sealing groove formed in the contacting surface of the backing plate adjacent the margin thereof and surrounding the group of grooves with the sealing groove opening toward the face plate;

a continuous strip of resilient material in said sealing groove;

said grooves being covered by the adjacent backing plate surface whereby the grooves form watercooling channels within the mold plate;

a laterally extending pocket formed in each of the opposite ends of the backing plate contacting surface with each pocket overlapping and opening into all of the grooves at their adjacent ends; and a pair of internal water-carrying passageways formed in the backing plate, each passageway extending from the backing plate exposed surface to one of said pockets whereby water may flow through one of said passageways and its respective pocket into adjacent ends of all of the grooves and then along the length of the grooves and out of the opposite ends of the grooves and their respective pocket and passageway for circulation of coolant through the mold plate, the improvment comprising:

the backing plate and face plate each having opposite aligned side edges which are curved in the same direction along the length thereof from one end to the opposite end of each of said plates;

each groove in the surface of the face plate being curved in its longitudinal direction to correspond to the curvature of the side edges of the face plate so that said side edges and the grooves each generally form a successively smaller arc of large radius curves with the arcs approximately parallel to one another; and said sealing groove being curved in its longitudinal direction along the side edge margin of the face plates and being substantially parallel to the adjacent face plate grooves in a curved path corresponding to the arc of curvature of the side edges of the mold plate;

so that the curvature of both the sealing groove and the water-carrying grooves reduces temperature differentials in the continuous strip of resilient material.

2. A construction as defined in claim 1, and wherein the opposite end walls of each groove gradually increases in depth along a curve from the surface of the face plate to the base of the groove to form curved end wall portions which are overlapped by said pockets for flow of water between the respective pockets and grooves.

3. A construction as defined in claim 1, and each of said grooves being of a substantially uniform narrow width which is considerably narrower than the depth of the grooves.

* * * * *